United States Patent [19]

Kubodera et al.

[11] Patent Number: 4,873,220

[45] Date of Patent: Oct. 10, 1989

[54] HEAT-SENSITIVE TRANSFER MATERIAL

[75] Inventors: Seiiti Kubodera; Takeshi Nakamine, both of Kanagawa, Japan

[73] Assignee: Fuji Photo Film Co., Ltd., Kanagawa, Japan

[21] Appl. No.: 236,473

[22] Filed: Aug. 25, 1988

[30] Foreign Application Priority Data

Aug. 25, 1987 [JP] Japan ..... 62-211154

[51] Int. Cl.[4] ..... B41M 5/035; B41M 5/26

[52] U.S. Cl. ..... 503/227; 8/471; 428/195; 428/336; 428/913; 428/914

[58] Field of Search ..... 8/471; 428/195, 913, 428/914, 336; 503/227

[56] References Cited

U.S. PATENT DOCUMENTS 4,695,287 9/1987 Evans et al. ..... 8/471

FOREIGN PATENT DOCUMENTS 2161824A 1/1986 European Pat. Off. ..... 503/227
1019396 1/1986 Japan ..... 503/227
1399958 7/1975 United Kingdom ..... 503/227

*Primary Examiner*—Bruce H. Hess
*Attorney, Agent, or Firm*—Sughrue, Mion, Zinn, Macpeak & Seas

[57] ABSTRACT

A heat-sensitive transfer material comprising a support having provided thereon a coloring material layer containing a dye represented by formula (I):

(I)

wherein $Q^1$ represents an atomic group containing at least one nitrogen atom required to form a nitrogen-containing heterocyclic ring containing 5 or more members together with the carbon atoms to which $Q^1$ is bonded;

$R^1$ represents an acyl group or a sulfonyl group;

$R^2$ represents a hydrogen atom or an aliphatic group containing from 1 to 6 carbon atoms;

$R^3$ represents a hydrogen atom, a halogen atom, an alkoxy group or an aliphatic group containing from 1 to 6 carbon atoms, and may be connected to $R^1$, $R^2$ or $R^4$ to form a ring;

$R^4$ represents a halogen atom, an alkoxy group or an aliphatic group containing from 1 to 6 carbon atoms;

$R^5$ and $R^6$, which may be the same or different, each represents a hydrogen atom, an aliphatic group containing from 1 to 6 carbon atoms or an aromatic group, and $R^5$ and $R^6$ may be connected to each other to form a ring, or at least one of $R^5$ and $R^6$ may be connected to $R^4$ to form a ring; and n represents an integer of from 0 to 4.

16 Claims, No Drawings

HEAT-SENSITIVE TRANSFER MATERIAL

FIELD OF THE INVENTION

The present invention relates to a heat-sensitive transfer material. More particularly, the present invention relates to a novel heat-sensitive transfer material which can easily produce a record image excellent in stability and fastnesses on a recording material.

BACKGROUND OF THE INVENTION

At present, color recording techniques such as by electrophotography, ink jet process, heat-sensitive transfer process or the like are known.

The heat-sensitive transfer recording process can be deemed to be of greater advantage than other processes because the equipment for use in such a process are easy to maintain and operate, and the equipment itself and the materials to be consumed are inexpensive.

The heat-sensitive transfer processes include a melt process and a sublimating process. In the melt process, a transfer sheet comprising a heat-meltable ink layer formed on a base film is heated by a thermal head so that the ink imagewise melt transferred to transfer images to a recording material. In the sublimating process, a transfer sheet comprising a coloring material layer containing a sublimable dye formed on a base film is heated by a thermal head so that the dye is imagewise sublimated and transfered to form an image on a recording material. In the sublimating process, the amount of the dye to be sublimated can be easily controlled by properly altering the energy applied to the thermal head. Thus, the sublimating process can easily provide records with a sufficient gradation. Accordingly, the sublimating process is particularly favorable for full-color recording.

In order to provide a cyan color record in the sublimating heat-sensitive transfer process, a transfer material comprising a coloring material layer containing a cyan dye may be used. However, conventional cyan color transfer materials are deficient in their properties. It has therefore been desired to develop improved cyan color transfer materials.

The dye to be incorporated in such cyan color transfer materials is required to satisfy various requirements described hereinafter.

Particularly, to be sutiable for a sublimating type heat-sensitive transfer process, a dye is required to be easily transferred under the normal operating conditions of the thermal recording head. Such a dye is also required to stand the normal temperature conditions of the heat-sensitive recording head without thermal decomposition. In order to provide an excellent color reproduction capability, such a dye is required to have a proper color hue and a great molecular extinction coefficient. Moreover, such a dye should be fast to heat, light, moisture, chemicals, and the like. Furthermore, such a dye should be easily synthesized. Furthermore, such a dye should be well adapted to be incorporated in an ink composition.

However, dyes which have been heretofore proposed have various deficiencies. For example, anthraquinone dyes as described in JP-A-60-151097 and 60-151098 (the term "JP-A" as used herein means an "unexamined published Japanese patent application") are disadvantageous in that they have a poor color hue. Indoaniline dyes as described in JP-A-61-22993 and British Patent 2,161,824 are disadvantageous in that they are poor in fastness to heat and light.

SUMMARY OF THE INVENTION

It is therefore an object of the present invention to provide a heat-sensitive transfer material containing a cyan dye satisfying the above described requirements.

The above and other objects and effects of the present invention will become more apparent from the following detailed description and examples.

These objects of the present invention are accomplished with a heat-sensitive transfer material comprising a support having provided thereon a coloring material layer containing a dye represented by formula (I):

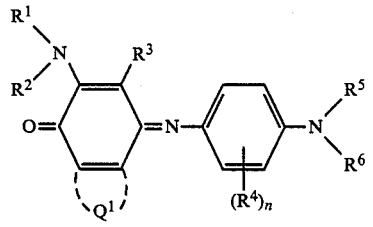

(I)

Wherein $Q^1$ represents an atomic group containing at least one nitrogen atom required to form a nitrogen-containing heterocyclic ring containing 5 or more members together with the carbon atoms to which $Q^1$ is bonded;

$R^1$ represents an acyl group or a sulfonyl group;

$R^2$ represents a hydrogen atom or an aliphatic group containing from 1 to 6 carbon atoms;

$R^3$ represents a hydrogen atom, a halogen atom, an alkoxy group or an aliphatic group containing from 1 to 6 carbon atoms, and may be connected to $R^1$, $R^2$ or $R^4$ to form a ring;

$R^4$ represents a halogen atom, an alkoxy group or an aliphatic group containing from 1 to 6 carbon atoms;

$R^5$ and $R^6$, which may be the same or different, each represents a hydrogen atom, an aliphatic group containing from 1 to 6 carbon atoms or an aromatic group, and $R^5$ and $R^6$ may be connected to each other to form a ring, or at least one of $R^5$ and $R^6$ may be connected to $R^4$ to form a ring; and n represents an integer of from 0 to 4.

DETAILED DESCRIPTION OF THE INVENTION $Q^1$ contains at least one nitrogen atom and represents an atomic group required to form a nitrogen-containing heterocyclic ring containing 5 or more members including the carbon atoms to which it is bonded. Examples of divalent groups capable of forming a ring together with said nitrogen atom include a divalent amino group, an ether group, a thioether group, an alkylene group, a vinylene group, an imino group, a sulfonyl group, a carbonyl group, an arylene group, and a divalent heterocyclic group. Two or more groups selected from these groups may be used in combination. These groups may further contain substituents.

$Q^1$ is preferably represented by $$-\overset{\overset{R^7}{|}}{N}-CO-Q^2-.$$

$Q^2$ is a divalent group. Examples of $Q^2$ include a divalent amino group, an ether group, a thioether group, an alkylene group, an ethylene group, an imino group, a sulfonyl group, a carbonyl group, an arylene group, a divalent heterocyclic group, and combinations of groups selected therefrom.

$R^7$ is a hydrogen atom or a group capable of bonding with a nitrogen atom represented by $—X^1—R^8$ in which $X^1$ represents chemical bond or a divalent connecting group. Examples of such a divalent connecting group include a divalent amino group, an ether group, a thioether group, an alkylene group, an ethylene group, an imino group, a sulfonyl group, a sulfoxy group, and a carbonyl group. A combination of groups selected from these groups may be used. These groups may further contain substituents.

$R^8$ represents a chain or cyclic, preferably having from 1 to 6 carbon atoms, an aliphatic group (such as methyl, butyl a and cyclohexyl), an aryl group (such as phenyl) or a heterocyclic ring (such as 2-pyridyl, 2-imidazolyl, 2-furyl). These groups may be substituted by at least one group selected from an alkyl group, an aryl group, a heterocyclic group, an alkoxy group (such as methoxy, 2-methoxyethoxy), an aryloxy group (such as 2-chlorophenoxy, 4-cyanophenoxy), an alkenyloxy group (such as 2-propenyloxy), an acyl group (such as acetyl, benzoyl), an ester group (such as butoxycarbonyl, phenoxycarbonyl, acetoxy, benzoyloxy, butoxysulfonyl, toluenesulfonyloxy), an amide group (such as acetylamino, ethylcarbamoyl, dimethylcarbamoyl, methanesulfonamide, butylsulfamoyl), a sulfamide group (such as dipropylsulfamoylamino), an imide group (such as succimide, hydantoinyl), a ureide group (such as phenylureide, dimethylureide), an aliphatic or aromatic sulfonyl group (such as methanesulfonyl, phenylsulfonyl), an aliphatic or aromatic thio group (such as ethylthio, phenylthio), a hydroxy group, a cyano group, a carboxy group, a nitro group, a sulfo group, and a halogen atom.

These aliphatic groups may be straight-chain, branched or cyclic. These aliphatic groups also may be saturated or unsaturated.

$R^1$ is preferably a group represented by $—CO—X^2—R^9$ $—SO_2—X^2—R^9$ in which $X^2$ represents —0—, $$—\overset{R^{10}}{\overset{|}{N}}—$$

or a chemical bond, and in which $R^9$ has the same meaning as $R^8$. $R^9$ is preferably an unsubstituted alkyl group or an alkyl or phenyl group of which hydrogen atoms are all substituted by hydrogen atoms. $R^{10}$ has the same meaning as $R^2$ which will be described hereinafter.

$R^2$ represents a hydrogen atom or an aliphatic group having from 1 to 6 carbon atoms (such as methyl, ethyl, iso-propyl, cyclohexyl, 2-ethylhexyl, allyl). These groups may contain substituents as described with reference to $R^8$.

$R^3$ represents a hydrogen atom, a halogen atom (such as F, Cl and Br), an alkoxy group (such as methoxy, ethoxy, propoxy), or an aliphatic group having from 1 to 6 carbon atoms (such as methyl, butyl, cyclohexyl). These groups may contain substituents as described with reference to $R^8$.

$R^4$ has the same meaning as $R^3$, with the proviso that $R^4$ does not represent a hydrogen atom. The suffix n represents an integer of from 1 to 4. If n is 2 or more, the plurality of $R^4$ groups may be the same or different.

$R^3$ may be connected to $R^1$, $R^2$ or $R^4$ to form a ring.

$R^5$ and $R^6$ each represents a hydrogen atom or an aliphatic or aromatic group as defined in $R^8$(including an aryl or heterocyclic groups as defined in $R^8$).

$R^5$ and $R^6$may be connected to each other to form a ring. $R^5$, $R^6$, or both may be connected to $R^4$ to form a ring.

Preferred among the dyes represented by formula (I) is a dye represented by formula (II):

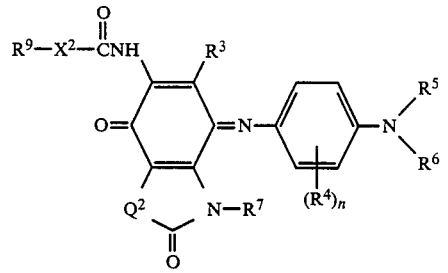

(II)

wherein $R^3$, $R^4$, $R^5$, $R^6$, $R^7$, $R^9$, $X^2$, and $Q^2$ are as defined above.

In formula (II) $R^7$ is preferably a hydrogen atom.

In formula (II) $Q^2$ is preferably an atomic group required to form a 5- to 7-membered ring.

In formula (II) $X^2$ is preferably a chemical bond.

Further preferred among the dyes represented by formula (I) is a dye represented by formula (III):

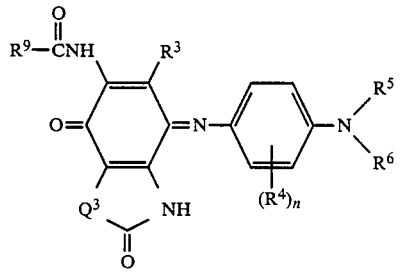

(III)

wherein $R^3$, $R^4$, $R^5$, $R^6$, and $R^9$ are as defined above; $Q^3$ represents $$—\overset{R^{11}}{\overset{|}{\underset{R^{12}}{\underset{|}{C}}}}—\overset{R^{13}}{\overset{|}{\underset{R^{14}}{\underset{|}{C}}}}—,\ —\overset{R^{11}}{\overset{|}{\underset{R^{12}}{\underset{|}{C}}}}— \text{ or } —\overset{R^{11}}{\overset{|}{N}}—;$$

and $R^{11}$, $R^{12}$, $R^{13}$ and $R^{14}$ each represents a hydrogen atom or a group which can be bonded to the carbon atom or nitrogen atom in $Q^3$ (including halogen atoms or groups as defined in $R^8$).

Specific examples of dyes represented by formula (I) and $\lambda_{max}$ of these dyes in ethyl acetate will be shown hereinafter, but the present invention should not be construed as being limited thereto.

(1)
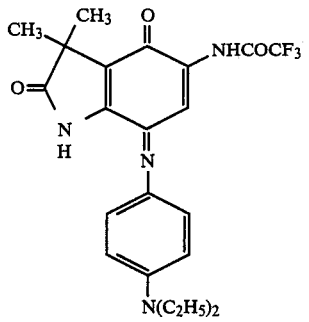
$\lambda_{max}$ = 615 nm
(2)
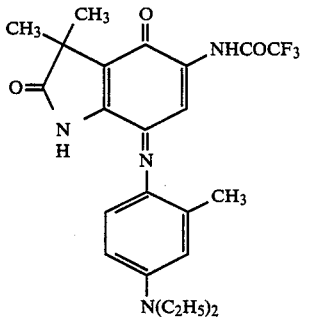
$\lambda_{max}$ = 641 nm
(3)
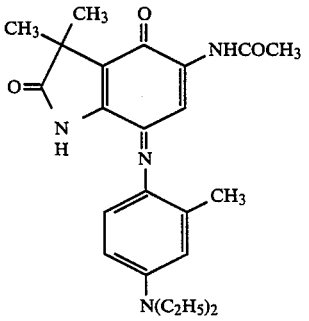
$\lambda_{max}$ = 615 nm
(4)
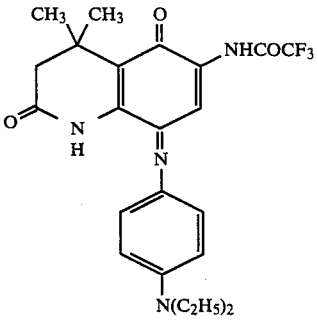
$\lambda_{max}$ = 618 nm
-continued
(5)
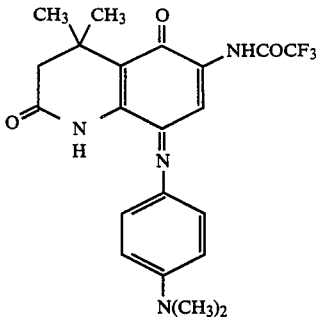
$\lambda_{max}$ = 608 nm
(6)
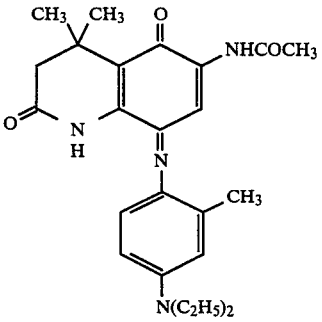
$\lambda_{max}$ = 618 nm
(7)
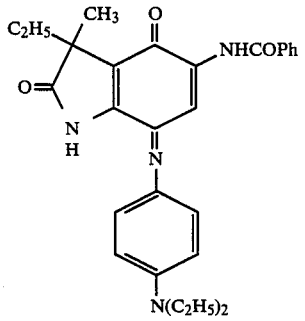
$\lambda_{max}$ = 609 nm
(8)
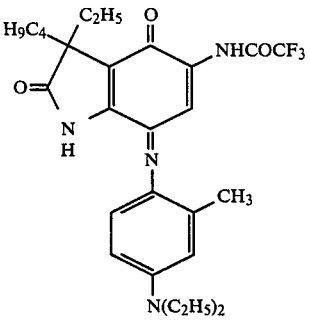
$\lambda_{max}$ = 641 nm -continued
(9)
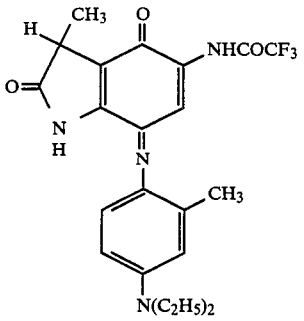
$\lambda_{max}$ = 643 nm
(10)
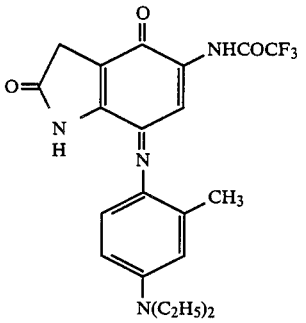
$\lambda_{max}$ = 642 nm
(11)
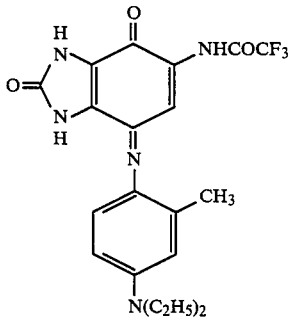
$\lambda_{max}$ = 644 nm
(12)
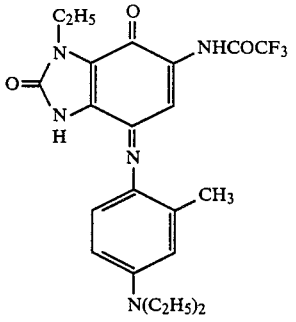
$\lambda_{max}$ = 650 nm
-continued
(13)
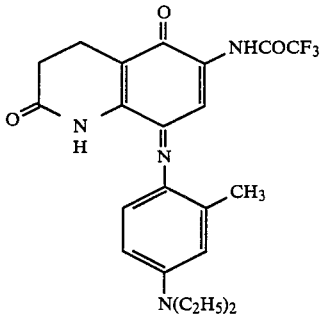
$\lambda_{max}$ = 644 nm
(14)
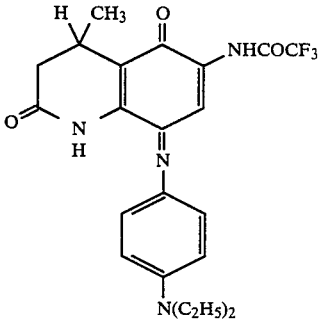
$\lambda_{max}$ = 620 nm
(15)
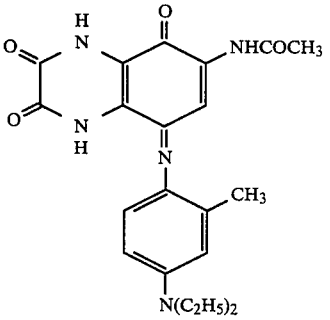
$\lambda_{max}$ = 627 nm
(16)
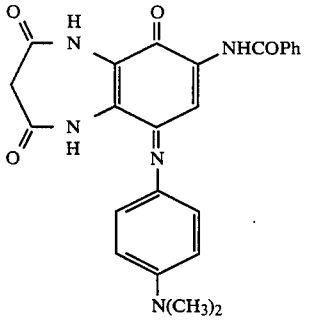
$\lambda_{max}$ = 633 nm -continued
(17)
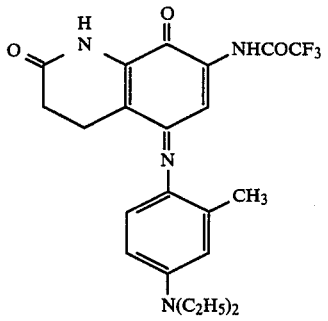
$\lambda_{max}$ = 676 nm
(18)
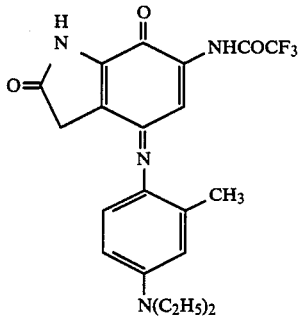
$\lambda_{max}$ = 675 nm
(19)
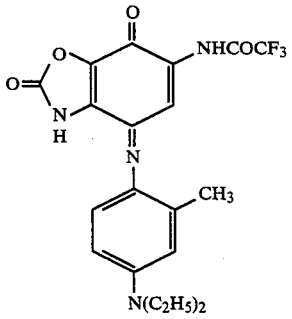
$\lambda_{max}$ = 641 nm
(20)
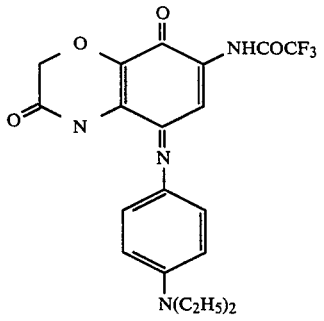
$\lambda_{max}$ = 642 nm
-continued
(21)
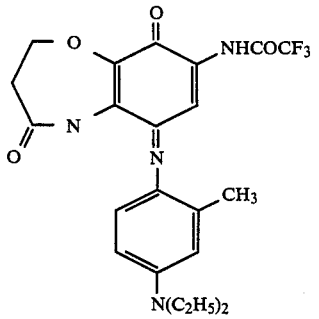
$\lambda_{max}$ = 642 nm
(22)
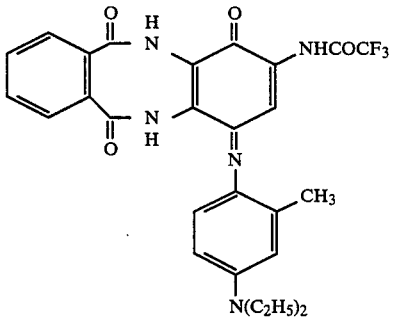
$\lambda_{max}$ = 635 nm
(23)
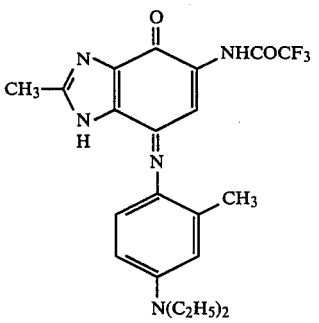
$\lambda_{max}$ = 620 nm
(24)
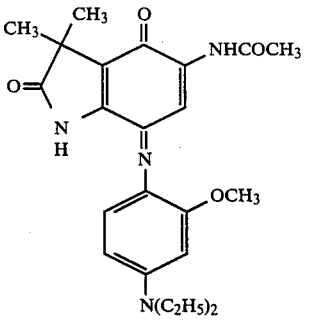
$\lambda_{max}$ = 620 nm -continued
(25)
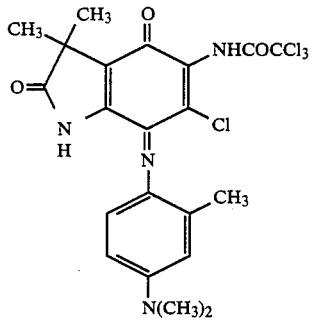
$\lambda_{max}$ = 647 nm
(26)
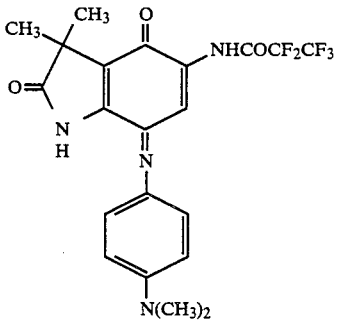
$\lambda_{max}$ = 620 nm
(27)
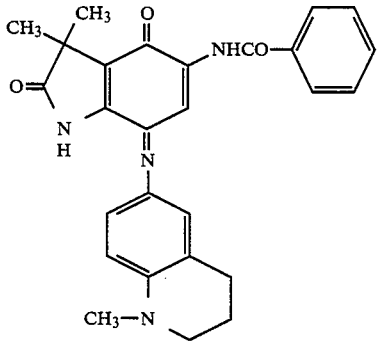
$\lambda_{max}$ = 641 nm
(28)
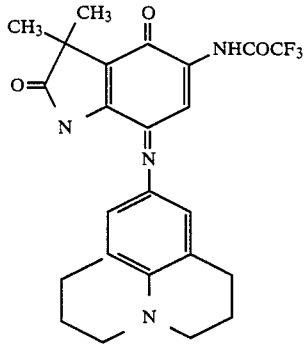
$\lambda_{max}$ = 658 nm
-continued
(29)
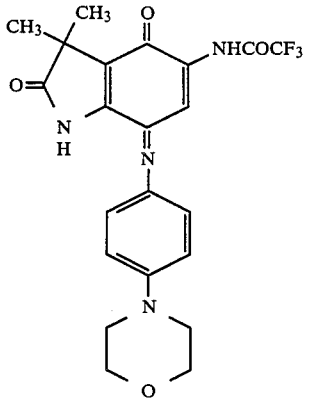
$\lambda_{max}$ = 618 nm
(30)
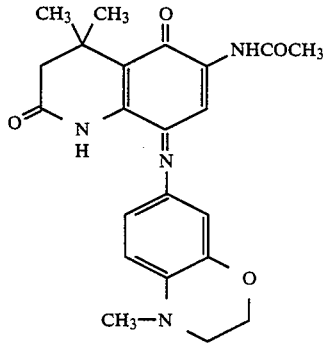
$\lambda_{max}$ = 630 nm
(31)
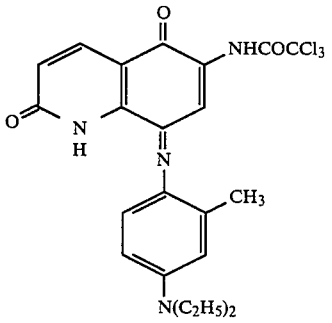
$\lambda_{max}$ = 642 nm
(32)
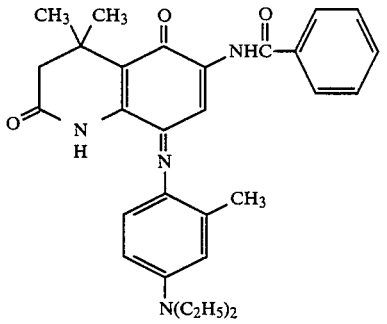
$\lambda_{max}$ = 635 nm -continued
(33)
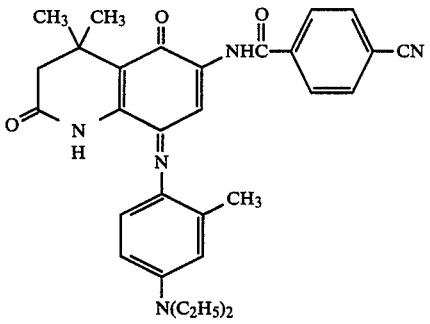
$\lambda_{max}$ = 633 nm
(34)
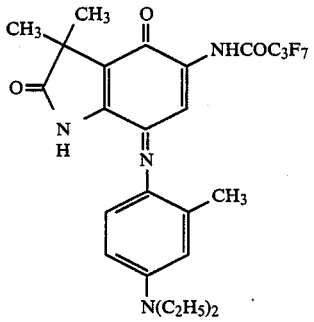
$\lambda_{max}$ = 654 nm
(35)
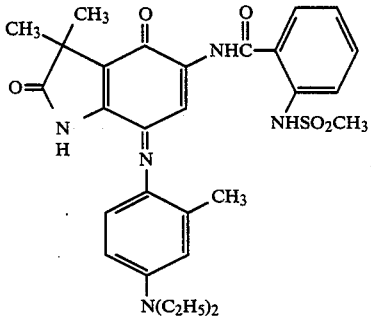
$\lambda_{max}$ = 647 nm
(36)
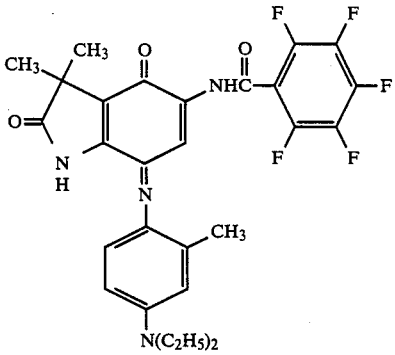
$\lambda_{max}$ = 634 nm
-continued
(37)
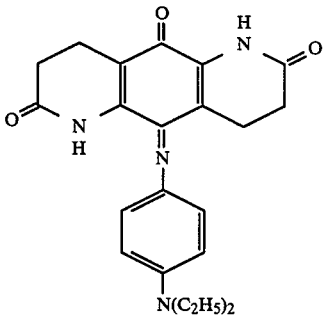
$\lambda_{max}$ = 615 nm
(38)
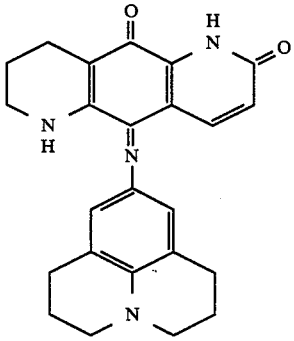
$\lambda_{max}$ = 655 nm
(39)
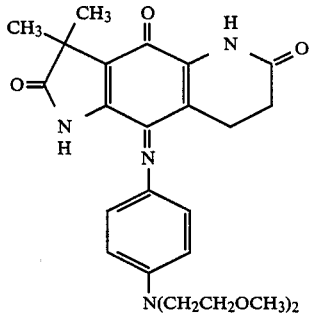
$\lambda_{max}$ = 620 nm
(40)
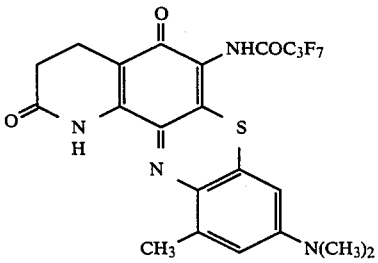
$\lambda_{max}$ = 610 nm -continued

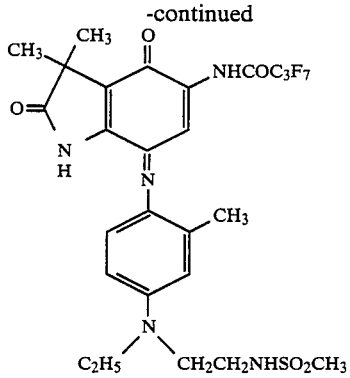

(41)

$\lambda_{max}$ = 646 nm

The preparation of the dye which can be used in the present invention can be accomplished by any suitable method such as one described in JP-A-62-29572, which is incorporated herein by reference, which comprises acylating the amino group in the compound represented by formula (IV):

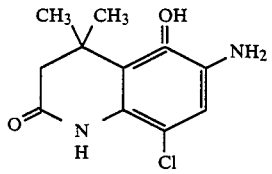

(IV)

and then allowing the compound thus acylated to undergo an oxidation coupling with a compound represented by formula (V):

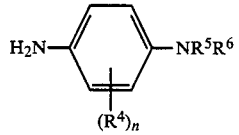

(V)

wherein $R^4$ to $R^6$ are as defined above, in the presence of ammonium persulfate or the like.

The heat-sensitive transfer material of the present invention is mainly charachterized by the use of a specific dye as described above. A first embodiment of the present invention is a heat-sensitive sublimable transfer layer wherein the coloring material layer comprises a heat-sublimable dye as described above and a binder resin. The heat-sensitive transfer material of this first embodiment can be obtained by dissolving or dispersing the above-described dye and a binder resin in a proper solvent to prepare a coating solution, coating the solution thus prepared on one surface of a support to a dry thickness preferably of from about 0.2 to 5.0 μm, more preferably from about 0.4 to 2.0 μm, and then drying the coat to form a coloring material layer.

As such a binder resin there may be used any known binder resin which is commonly used for such a purpose. In General, a high heat-resistant binder resin which does not prevent the heat-sublimable dye from subliming when heated is selected. Examples of such a binder resin include polyamide resin, polyester resin, epoxy resin, polyurethane resin, polyacrylate resin such as polymethylmethacrylate, and polyacrylamide, vinyl resin such as polyvinylpyrrolidone, polyvinyl chloride resin such as vinyl chloride-vinyl acetate copolymer, cellulose resin such as methyl cellulose, ethyl cellulose, and carboxymethyl cellulose, polyvinyl alcohol resin such as polyvinyl alcohol, and partially saponified polyvinyl alcohol, acrylic acid resin, starch high molecular compound, petroleum resin, rosin derivative, cumaroneindene resin, terpene resin, novolak type phenol resin, polystyrene resin, polyolefin resin such as polyethylene, and polypropylene, polycarbonate, polysulfone, and polyethersulfone.

The amount of such a binder resin to be used is preferably in the range of from about 80 to 600 parts by weight, more preferably from about 100 to 400 parts by weight, based on 100 parts by weight of the dye.

As a suitable ink solvent for dissolving or dispersing the above described dye and binder resin there may be used a known ink solvent. Specific examples of such an ink solvent include water-soluble alcohol solvent such as methanol, ethanol, isopropyl alcohol, butanol, and isobutanol, ester solvent such as ethyl acetate, and butyl acetate, ketone solvent such as methyl ethyl ketone, methyl isobutyl ketone, and cyclohexane, aromatic solvent such as toluene, xylene, and chlorobenzene, halogenic solvent such as dichloromethane, trichloroethane, and chloroform, N,N-dimethylformamide, N-methylpyrrolidone, dioxane, tetrahydrofuran, Cellosolve type solvent such as ethylene glycol monomethyl ether, ethylene glycol monoethyl ether and mixtures thereof. It is necessary that these solvents be appropriately selected such that the above described dye can be dissolved or dispersed therein in the predetermined concentration or higher concentration and the above described binder can be sufficiently dissolved or dispersed therein. For example, these solvents are preferably used in an amount of about 9 to 20 times by weight the total weight of the above described dye and the binder resin.

As a suitable support for the present heat-sensitive transfer material there may be used any known material having some heat-resistance and strength. Examples of such a material include paper, coated paper, polyester film, polystyrene film, polypropylene film, polysulfone film, polycarbonate film, polyphenylene sulfide film, polyvinyl alcohol film, and cellophane film having a thickness of 0.5 to 50 μm, preferably 3 to 10 μm. Particularly preferred among these materials is polyester film.

The coating of an ink on the base film can be accomplished by means of a reverse roll coater, gravure coater, rod coater, air doctor coater, or the like.

The above described heat-sensitive transfer material so constructed is fully useful in the present invention. However, the above described heat-sensitive transfer material may further comprise an adhesion inhibiting layer, i.e., release layer provided on the surface of the coloring material layer. The provision of such a release layer enables the prevention of the adhesion between the heat-sublimatable transfer material and the recording material and enables the use of a higher heat transfer temperature, making it possible to form an image having a higher and thus more excellent density.

Such a release layer can be formed merely by allowing powdered adhesion-inhibiting inorganic material to be attached to the surface of the coloring material layer. The release layer thus formed exhibits a relatively good effect. Such a release layer can also be formed by providing a layer of 0.01 to 5 μm thick, preferably 0.05 to 2 μm thick, of a resin excellent in release properties such as silicone polymer, acryl polymer, and fluorinated polymer.

The above described inorganic powder or releasing polymer may be incorporated in the coloring material layer to provide a sufficient effect as a release layer.

The heat-sensitive transfer material may further comprise a heat-resistance layer provided on the back surface thereof to protect against adverse effects of heat from the thermal head.

The heat-sensitive transfer material thus obtained is then laminated onto a known receiving sheet. When such a lamination is heated by a heating means such as thermal head from any side, preferably from the heat-sensitive transfer material side in accordance with the image signal, the dye incorporated in the coloring material can be easily transferred to the receiving layer in the receiving material by a relatively low energy and in response to the magnitude of the heating energy, making it possible to form a color image having an excellent sharpness and a resolving gradation.

A second preferred embodiment of the present invention is a heat-sensitive transfer material wherein the coloring material layer is a heat-sensitive melt transfer layer comprising the present dye and a wax.

The second embodiment of the heat-sensitive transfer material can be formed by providing a coloring material layer comprising a wax containing the dye on one surface of the support as described above. Such a heat-sensitive transfer material comprises a dye dispersed in a wax having a proper melting point such as paraffin wax, microcrystalline wax, carnauba wax, and urethane wax as a binder. The proportion of the dye in the coloring material layer is preferably in the range of from about 10 to 65 wt%. The thickness of the coloring material layer thus formed is preferably in the range of from about 1.5 to 6.0 μm. The preparation of the dye and application of the dye to the support can be accomplished by any suitable known method.

The second preferred embodiment of the heat-sensitive transfer material can be used in the same manner as the first preferred embodiment so that the coloring material is transferred to the receiving layer, providing excellent prints.

The dye represented by formula (I) exhibits a sharp cyan color. Therefore, a combination of such a dye with proper magenta dye and yellow dyes are suitable for the full color recording with an excellent color reproducibility. Furthermore, since the dye represented by formula (I) has a great molecular extinction coefficient, recording can be provided at a high speed with a high color density without having a great energy expenditure from a heat-sensitive head. Moreover, since the dye represented by formula (I) is fast to heat, light, moisture and chemicals, it gives an excellent preservability of record and no thermal decomposition during the transfer process. The dye of the present invention has an excellent solubility in an organic solvent and an excellent dispersibility in water. Therefore, a high density ink comprising the present dye uniformly dissolved or dispersed in a solvent can be easily prepared. The use of such an ink can provide a heat-sensitive transfer material comprising a high density uniformly coated layer of the dye. Accordingly, the use of such a heat-sensitive transfer material can provide a record excellent in uniformity and color density.

The present invention will be further described hereinafter in the following examples, but the present invention should not be construed as being limited thereto.

EXAMPLE 1

Preparation of ink

| | |
|---|---|
| Dye (Compound (5)) | 4 g |
| Polyvinyl butyral resin (Denki Kagaku Co., Ltd., Denka Butyral 5000-A) | 4 g |
| Toluene | 40 ml |
| Methyl ethyl ketone | 40 ml |
| Polyisocyanate (Takeda Chemical Industries, Ltd., Takenate D110N) | 0.2 ml |

A mixture of the above described compositions was processed by an ink conditioner for one hour to prepare an ink.

Preparation of heat-sensitive transfer material

The ink thus prepared was then coated on a 6 μm thick polyethylene terephthalate film by means of a wire bar #20. The coat was then subjected to air drying to prepare a heat-sensitive transfer material.

An ink receiving layer composition having the undermentioned components was coated on a 150 μm thick coated paper (Oji Petrochemical Co., Ltd., YUPO-FPG 150) as a base material to a dried thickness of 5 g/m$^2$ to prepare a receiving sheet. The drying was achieved temporarily by an air drier, and then completely dried in an oven at a temperature of 100° C. for 1 hour to allow the solvent to be fully evaporated.

Ink composition for receiving layer

| | |
|---|---|
| Vylon 103 (Toyobo Co., Ltd., polyester resin) | 8 parts |
| Erbaroy 741 (Mitsui Polychemical Co., Ltd., EVA series high molecular plasticizer) | 2 parts |
| Amino-modified silicone oil (Shinetsu Silicone Co., Ltd., KF-393) | 0.125 parts |
| Epoxy-modified silicone oil (Shinetsu Silicone Co., Ltd., X-22343) | 0.125 parts |
| Toluene | 70 parts |
| Methyl ethyl ketone | 10 parts |
| Cyclohexanone | 20 parts |

The heat-sensitive transfer material thus obtained and the receiving sheet thus obtained were laminated in such a manner that the coloring material layer and the receiving layer were kept in contact with each other. Recording was then conducted by heating the heat-sensitive transfer material from the support side by a thermal head at an output of 1 W/dot, a pulse width of 0.3 to 4.5 msec, and a dot density of 6 dots/mm. As a result, a sharp cyan image was obtained. A record having a gradation corresponding to the energy applied was obtained. The gradation was such that the reflection density of a high density colored portion obtained with a pulse width of 4.5 msec. was 1.70 while that of a low density colored portion obtained with a pulse width of 0.3 m sec. was 0.13 as determined by a Macbeth densitometer RD-918.

EXAMPLES 2 to 10

Heat-sensitive transfer materials were prepared in the same manner as in Example 1 except in that the dye and binder used in Example 1 were replaced by dyes and binders shown in Table 1. Transfer recording was then conducted using these heat-sensitive transfer materials. As a result, sharp cyan recorded images having color densities as shown in Table 1 were obtained.

TABLE 1

| No. | Dye (exemplary compound) | Binder | Color density (high density portion) |
|---|---|---|---|
| 2 | (2) | Polyvinyl butyral 5000A | 1.65 |
| 3 | (3) | " | 1.70 |
| 4 | (9) | " | 1.60 |
| 5 | (16) | " | 1.65 |
| 6 | (3) | Ethyl cellulose | 1.80 |
| 7 | (19) | " | 1.50 |
| 8 | (24) | " | 1.60 |
| 9 | (27) | Polysulfone (Nissan Chemical Industries, Ltd., Udel P-1700) | 1.60 |
| 10 | (36) | " | 1.55 |

EXAMPLE 11

In order to examine the recorded images obtained in Examples 1, 2 and 6 for light fastness, the sheets an which images had been recorded were then irradiated with light from a xenon lamp weathermeter (Atlas Inc., U.S.) for 48 hours. In order to examine these records for heat resistance, these sheets were subjected to a forced heating test at a temperature of 60° C. for 7 days, and then measured for color deterioration. The results of these tests are shown in Table 2 together with the data of the comparative dye (A):

Comparative dye (A)

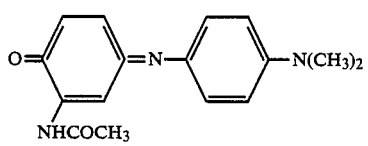

TABLE 2

| Example | Deterioration due to light | Deterioration due to heat |
|---|---|---|
| Comparative dye (A) | 80% | 30% |
| Example 1 | 10% | 5% |
| Example 2 | 10% | ca. 0% |
| Example 6 | 15% | 5% |

The results show that the dyes of the present invention exhibit improved light fastness and heat fastness as compared to a conventional heat-sensitive transfer recording indoaniline dye which have been heretofore known.

EXAMPLE 12

Hexamethylene diisocyanate and ethyl alcohol were mixed in amounts such that —NCO and —OH were equimolecular with each other. The mixture was then heated to a temperature of 80° C. with stirring for 10 hours to obtain a wax-like material. The product thus obtained had a melting point of 83°to 86° C. The presence of —NCO in the product was not confirmed by an infrared spectrophotometer.

The product thus obtained was then mixed with other components shown below at room temperature by means of a ball mill. As a result, a gravure ink composition having a viscosity of 300 C.P. at 25° C. was obtained.

Gravure ink composition

| | |
|---|---|
| Product obtained as described above | 30 parts |
| Dye (Compound (1)) | 3 parts |
| Ethyl alcohol | 50 parts |
| Isopropyl alcohol | 17 parts |

The gravure ink composition thus obtained was then coated on a 8 μm thick polyethylene terephthalate film as used in Example 1 by means of a gravure coater to a dried thickness of 3 μm to prepare a heat-sensitive transfer material of the present invention. Printing was then conducted using the heat-sensitive transfer material thus prepared by means of a printer equipped with a thermal head (Toshiba Corporation, F-1610). As a result, cyan prints having a sharp image density contour were obtained.

These prints were then examined by subjecting to the same tests as in Example 11. The results show that these records exhibit little deterioration and have an excellent fastness.

EXAMPLE 13

The same ink as used in Example 1 was coated on one side of a 4 μm thick polyethylene terephthalate film in the same manner as in Example 1. After the coat was dried, a resistive layer of the undermentioned composition was coated on the other side of the polyethylene terephthalate film. The coat was then dried. As a result, an electrical conduction type heat-sensitive transfer material was obtained.

| Component | Mixing proportion (wt %) |
|---|---|
| Toluene | 25 |
| Methyl ethyl ketone | 25 |
| Methyl isobutyl ketone | 25 |
| Polyester (Toyobo Co., Ltd., Vylon 290) | 15 |
| Carbon black (Mitsubishi Chemical Industries, Ltd., MA-100) | 7 |
| Dispersant (Kao Corp., Demole-N) | 3 |

The transfer material thus obtained was then laminated with a receiving sheet in such a manner that the ink-coated surface of the transfer material and the image receiving layer of the receiving sheet were kept in contact with each other. An electric current was passed through the resistive layer from electrodes so that the resistive layer was heated. As a result, a transferred record was obtained. The electrode density was 6 dots/mm. The printing energy was 0.8 mj/dot. A sharp cyan print was produced on the receiving sheet.

While the invention has been described in detail and with reference to specific embodiments thereof, it will be apparent to one skilled in the art that various changes and modifications can be made therein without departing from the spirit and scope thereof.

What is claimed is:

1. A heat-sensitive transfer material comprising a support having provided thereon a coloring material layer containing binder and a dye represented by formula (I):

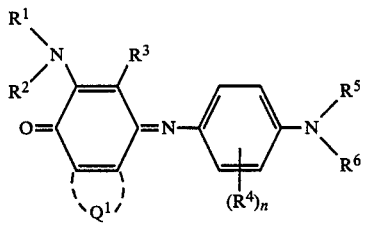

(I)

wherein $Q^1$ represents an atomic group containing at least one nitrogen atom required to form a nitrogen-containing heterocyclic ring containing 5 or more members together with the carbon atoms to which $Q^1$ is bonded;

$R^1$ represents an acyl group or a sulfonyl group;

$R^2$ represents a hydrogen atom or an aliphatic group containing from 1 to 6 carbon atoms;

$R^3$ represents a hydrogen atom, a halogen atom, an alkoxy group or an aliphatic group containing from 1 to 6 carbon atoms, and may be connected to $R^1$, $R^2$ or $R^4$ to form a ring;

$R^4$ represents a halogen atom, an alkoxy group or an aliphatic group containing from 1 to 6 carbon atoms;

$R^5$ and $R^6$, which may be the same or different, each represents a hydrogen atom, an aliphatic group containing from 1 to 6 carbon atoms or an aromatic group, and $R^5$ and $R^6$ may be connected to each other to form a ring, or at least one of $R^5$ and $R^6$ may be connected to $R^4$ to form a ring; and n represents an integer of from 0 to 4.

2. A heat-sensitive transfer material as claimed in claim 1, wherein $Q^1$ contains a divalent group selected from the group consisting of a divalent amino group, an ether group, a thioether group, an alkylene group, a vinylene group, an imino group, a sulfonyl group, a carbonyl group, an arylene gorup, a divalent heterocyclic group and combinations of these groups.

3. A heat-sensitive transfer material as claimed in claim 1, wherein $Q^1$ is represented by $$-\overset{R^7}{\overset{|}{N}}-CO-Q^2-$$

wherein $R^7$ represents a hydrogen atom or a group represented by $-(X^1)_m-R^8$ wherein $X^1$ represents a divalent connecting group, m represents 0 to 1 and $R^8$ represents a chain or cyclic aliphatic group, an aryl group or a heterocyclic group; and $Q^2$ represents a divalent group.

4. A heat-sensitive transfer material as claimed in claim 3, wherein $Q^2$ represents a group selected from the group consisting of a divalent amino group, an ether group, a thioether group, an alkylene group, an imino group, a sulfonyl group, a carbonyl group, an arylene group, a divalent heterocyclic group and combinations of these groups.

5. A heat-sensitive transfer material as claimed in claim 3, wherein $X^1$ represents a divalent group selected from the group consisting of a divalent amino group, an ether group, a thioether group, an alkylene group, an imino group, a sulfonyl group, a carbonyl group and combinations of these groups.

6. A heat-sensitive transfer material as claimed in claim 3, wherein $R^8$ represents a substituted or unsubstituted aliphatic group containing from 1 to 6 carbon atoms, a substituted or unsubstituted aryl group or a substituted or unsubstituted hetrocyclic group.

7. A heat-sensitive transfer material as claimed in claim 1, wherein $R^1$ represents a group represented by $-CO-(X^2)_m-R^9$ or $-SO_2-(X^2)_m-R^9$ wherein $(X^2)_m$ represents —0—or $$-\overset{R^{10}}{\overset{|}{N}}-,$$

m represents 0 or 1 , $R^9$ represents a chain or cyclic aliphatic group, an aryl group or a heterocyclic group, and $R^{10}$ has the same meaning as $R^2$.

8. A heat-sensitive transfer material as claimed in claim 1, wherein $R^2$ represents a methyl group, an ethyl group, an iso-propyl group, a cyclohexyl group, a 2-ethylhexyl group or an allyl group.

9. A heat-sensitive transfer material as claimed in claim 1, wherein $R^3$ and $R^4$, which may be the same or different, each represents a fluorine atom, a chlorine atom, a bromine atom, a methoxy group, an ethoxy group, a propoxy group, a methyl group, a butyl group or a cyclohexyl group.

10. A heat-sensitive transfer material as claimed in claim 1, wherein said dye represented by formula (I) is a dye represented by formula (II):

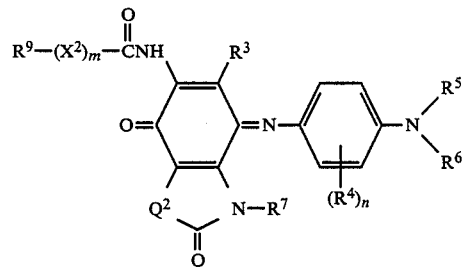

(II)

wherein $R^3$, $R^4$, $R^5$ and $R^6$ are as defined in claim 1, $R^7$ represents a hydrogen atom or a group represented by $-(X^1)_m-R^8$ wherein $X^1$ represents a divalent connecting group, m represents 0 or 1, and $R^8$ represents a chain or cyclic aliphatic group, an aryl group or a heterocyclic group, $R^9$ represents a chain or cyclic aliphatic group, an aryl group or a heterocyclic group, $(X^2)_m$ represents —0—or $$-\overset{R^{10}}{\overset{|}{N}}-,$$

m is 0 or 1 and $Q^2$ represents a group selected from the group consisting of a divalent amino group, an ether group, a thioether group, an alkylene group, an emino group, a sulfonyl group, a carbonyl group, an arylene group, a divalent heterocyclic group and combinations of these groups.

11. A heat-sensitive transfer material as claimed in claim 10, wherein $R^7$ represents a hydrogen atom, $Q^2$ represents an atomic group required for forming a nitrogen-containing ring containing from 5 to 7 members, and m represents 0.

12. A heat-sensitive transfer material as claimed in claim 1, wherein said dye represented by formula (I) is a dye represented by formula (III):

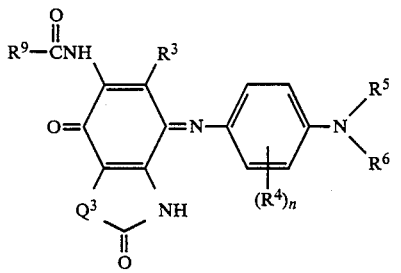

(III)

wherein $R^3$, $R^4$, $R^5$, $R^6$ each has the same meaning as defined above, $R^9$ represents a chain or cyclic aliphatic group, an aryl group or a heterocyclic group and $Q^3$ represents

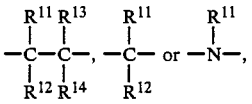

wherein $R^{11}$, $R^{12}$, $R^{13}$ and $R^{14}$, which are the same or different, each represents a hydrogen atom, a substituted or unsubstituted aliphatic group containing from 1 to 6 carbon atoms, a substituted or unsubstituted aryl group or a substituted or unsubstituted heterocyclic group.

13. A heat-sensitive transfer material as claimed in claim 1, wherein the thickness of said coloring material layer is from about 0.2 to 5.0 μm.

14. A heat-sensitive transfer material as claimed in claim 13, wherein the thickness of said coloring material layer is from about 0.4 to 2.0 μm.

15. A heat-sensitive transfer material comprising a support having providing thereon a coloring material layer containing a dye represented by formula (I):

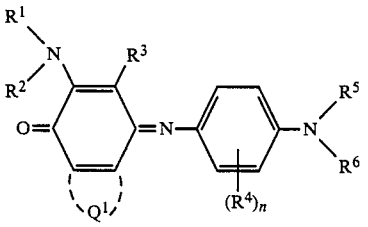

(I)

wherein $Q^1$ represents an atomic group containing at least one nitrogen atom required to form a nitrogen-containing heterocyclic ring containing 5 or more members together with the carbon atoms to which $Q^1$ is bonded;

$R^1$ represents an acyl group or a sulfonyl group;

$R^2$ represents a hydrogen atom or an aliphatic group containing from 1 to 6 carbon atoms;

$R^3$ represents a hydrogen atom, a halogen atom, an alkoxy group or an aliphatic group containing from 1 to 6 carbon atoms, and may be connected to $R^1$, $R^2$ or $R^4$ to form a ring;

$R^4$ represents a halogen atom, an alkoxy group or an aliphatic group containing from 1 to 6 carbon atoms;

$R^5$ and $R^6$, which may be the same or different, each represents a hydrogen atom, an aliphatic group containing from 1 to 6 carbon atoms or an aromatic group, and $R^5$ and $R^6$ may be connected to each other to form a ring, or at least one of $R^5$ and $R^6$ may be connected to $R^4$ to form a ring; and n represents an integer of from 0 to 4 , wherein said coloring material layer further contains a binder in an amount of from about 80 to 600 parts by weight per 100 parts by weight of said dye.

16. A heat-sensitive transfer material comprising a support having providing thereon a coloring material layer containing a dye represented by formula (I):

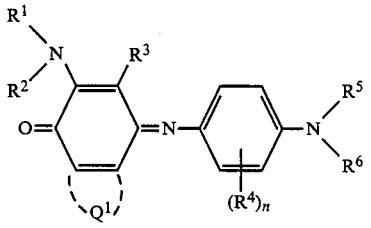

(I)

wherein $Q^1$ represents an atomic group containing at least one nitrogen atom required to form a nitrogen-containing heterocyclic ring containing 5 or more members together with the carbon atoms to which $Q^1$ is bonded;

$R^1$ represents an acyl group or a sulfonyl group;

$R^2$ represents a hydrogen atom or an aliphatic group containing from 1 to 6 carbon atoms;

$R^3$ represents a hydrogen atom, a halogen atom, an alkoxy group or an aliphatic group containing from 1 to 6 carbon atoms, and may be connected to $R^1$, $R^2$ or $R^4$ to form a ring;

$R^4$ represents a halogen atom, an alkoxy group or an aliphatic group containing from 1 to 6 carbon atoms;

$R^5$ and $R^6$, which may be the same or different, each represents a hydrogen atom, an aliphatic group containing from 1 to 6 carbon atoms or an aromatic group, and $R^5$ and $R^6$ may be connected to each other to form a ring, or at least one of $R^5$ and $R^6$ may be connected to $R^4$ to form a ring; and n represents an integer of from 0 to 4, and wherein said coloring material layer further contains a wax in addition to said dye wherein the proportion of the dye in the coloring material layer is in the range of from about 10 to 65 wt%.

* * * * *